US005887718A

United States Patent [19]

Oslin et al.

[11] Patent Number: 5,887,718

[45] Date of Patent: Mar. 30, 1999

[54] ARTICLE TRANSPORT AND STORAGE DEVICE

[75] Inventors: John A. Oslin, Canton; James R. Stein, Linden; James P. Olender, Fenton; Donald E. Schultz, Clarkston, all of Mich.

[73] Assignee: Creative Foam Corporation, Fenton, Mich.

[21] Appl. No.: 44,434

[22] Filed: Mar. 19, 1998

[51] Int. Cl.[6] ..... B65D 85/62

[52] U.S. Cl. ..... 206/499; 206/335; 206/445; 211/23; 211/59.4

[58] Field of Search ..... 206/303, 335, 206/445, 499, 587; 211/23, 59.4, 150; 312/327

[56] References Cited

U.S. PATENT DOCUMENTS 5,324,105 6/1994 Christensen ..... 312/319.4
5,339,958 8/1994 Taravella et al. ..... 206/521
5,509,534 4/1996 Taravella et al. ..... 206/587

*Primary Examiner*—Jim Foster
*Attorney, Agent, or Firm*—Young & Basile, PC

[57] ABSTRACT

A base mountable in a container supports a plurality of article support members having notches offset from notches in adjacent article support members for supporting articles in a horizontally nested orientation. Additional article support members are engagable with upper portions of the articles for receiving articles in a second overlaying tier in which the second tier of articles are nested vertically within the first tier of articles as well as horizontally from other articles in the second tier of articles. Each article support member is formed of an extruded tubular member having exterior flanges which receive a rack carrying the notches. The rack is formed of cross-linked polyethylene.

17 Claims, 6 Drawing Sheets

ARTICLE TRANSPORT AND STORAGE DEVICE

BACKGROUND OF THE INVENTION

1. Field of the Invention

The present invention relates, in general, to an article transport and storage apparatus and, more specifically, to apparatus for storing and transporting circular articles, such as vehicle steering wheels, from the manufacturing facility to the installation plant.

2. Description of the Art

Storage racks are used to store articles, such as steering wheels, in the manufacturing plant and for transporting the articles to the installation plant to make to steering wheels available in an easily accessible position adjacent to the production line for installation in a vehicle.

One steering wheel storage rack utilizes a number of vertical spindles in a container which store the steering wheels in vertical stacks through the center hole in each steering wheel. This type of steering wheel storage apparatus has been obsolete due to the trend toward integrated assemblies in which the air bag and steering wheel are integrated into an assembly in the steering wheel manufacturing plant and shipped to the installation plant in a single assembly operation.

Another steering wheel storage rack employs a metal frame with a plurality of vertically arranged, pivotal shelves. Each shelf supports two pairs of spaced, article support members formed of molded urethane foam or E.V.A. with spaced notches sized to receive a peripheral portion of each steering wheel. The notches are offset in two article support members to nest each steering wheel in each row vertically between portions of steering wheels in adjacent top and bottom rows.

Another steering wheel rack utilizes a square wood stud with four notched racks of cellular polyethylene mounted by means of adhesive on the four sides of the stud. The ends of the racks are mounted in supports attached to the inner sides of a container in a vertically and horizontally spaced matrix arrangement of rows and layers. The notches in the racks are offset from end to end to nest the steering wheels in horizontal rows.

It would be desirable to provide further improvements to article storage apparatus, such as storage apparatus devised for storing and transporting steering wheels from a steering wheel manufacturing facility to the installation plant. It would be desirable to provide an article storage apparatus in which the articles are arranged in horizontal and vertical rows and are nested in two dimensions, i.e., horizontally and vertically, to increase the number of articles which can be stored in a single container. It would also be desirable to provide such an article storage apparatus which is constructed of a minimal amount number of different components. It would also be desirable to provide such an article storage apparatus which is durable for long term reuse. It would also be desirable to provide such an article storage apparatus in which the article storage racks are formed of a material resistant to dirt while at the same time being compatible with a Class A article surface. Finally, it would be desirable to provide such an article storage apparatus in which vertical rows of articles are supported on underlying rows without attachment to the container.

SUMMARY OF THE INVENTION

The present invention is an apparatus for storing and transporting a plurality of articles, such as articles having a peripheral annular surface, i.e., vehicle steering wheels, in a container having side walls and a base.

In a preferred embodiment, the article support transport apparatus includes article support means for supporting the peripheral surfaces of a plurality of articles in at least one longitudinally extending row wherein the article support members are disposed independently of or freestanding with respect to the side wall of the container. The article support means includes a plurality of notches for receiving the peripheral surface of a plurality of articles, the notches being longitudinally offset from notches in adjacent articles support means to nest portions of the articles in two adjacent rows between each other.

The article support means also includes notches arranged to two dimensionally nest the articles in two adjacent vertical and two adjacent horizontal rows with respect to each other.

Preferably the article support means includes a tubular member having at least a two side surfaces. Preferably the tubular member is a hollow, extrusion. A rack carries the plurality of notches. Mounting means are provided for mounting each rack to one of the side surfaces of the tubular member. In a preferred embodiment, the mounting means comprises inward extending flanges formed on the side surfaces of the tubular member and defining an open ended slot which receive side slots formed on the bottom of each rack. The racks are arranged in a reversed 180° orientation with respect to each other on two side surfaces of the tubular member.

In an alternate embodiment, the racks are arranged in two co-linear pairs on four surfaces of the tubular member. Notches on each of the racks are equally spaced from each other along each rack. One endmost notch is spaced closer to the first end of each rack than the opposite endmost notch is from the second end of the rack.

Notches in each co-linear pair of racks are aligned; while notches in the opposed pairs of racks are longitudinally offset from the notches in the other pair of racks.

In a preferred embodiment, a pair of side wall members are mountable in the container for supporting the article support means on the base of the container. Means are provided for interconnecting the article support means and the sidewall members. Preferably, the interconnecting means comprises the opposed ends of each tubular member extending outward beyond the ends of the racks mounted thereon and engagable with apertures in the side wall members.

Preferably, pair of side wall members are interconnected by a bottom wall, in a one-piece, integral assembly. A central support rib is mountable on the bottom wall of the base between the side wall members for supporting the article support members.

The article transport and support apparatus of the present invention provides significant advantages when compared to previously devised article support apparatus, particularly article support apparatus designed for storing and transporting articles having a circular or annular exterior surface, such as a vehicle steering wheel. The present apparatus is formed of a minimal number of different components for a low manufacturing cost. The racks are formed of a durable, long life cross-linked poly ethylene or equivalent material which is ideally suited for contacting the Class A surface of a vehicle steering wheel without discoloring, indenting, scratching or marring the steering wheel. The racks are identically constructed; but mounted on each tubular article support member in 180° reverse manner to provide two dimensional nesting of the steering wheels within the container wherein the steering wheels are nested within steering wheels in adjacent horizontal rows and adjacent vertical rows to increase the density and total number of steering wheels which can be stored within a single container.

The article support means also enables upper rows of steering wheels to be supported in a free standing manner on lower rows of steering wheels without requiring any interconnection to sidewalls of the container. This simplifies the mounting of the apparatus within the container as well as reducing the overall cost of the article storage apparatus.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENT

Figure 1:
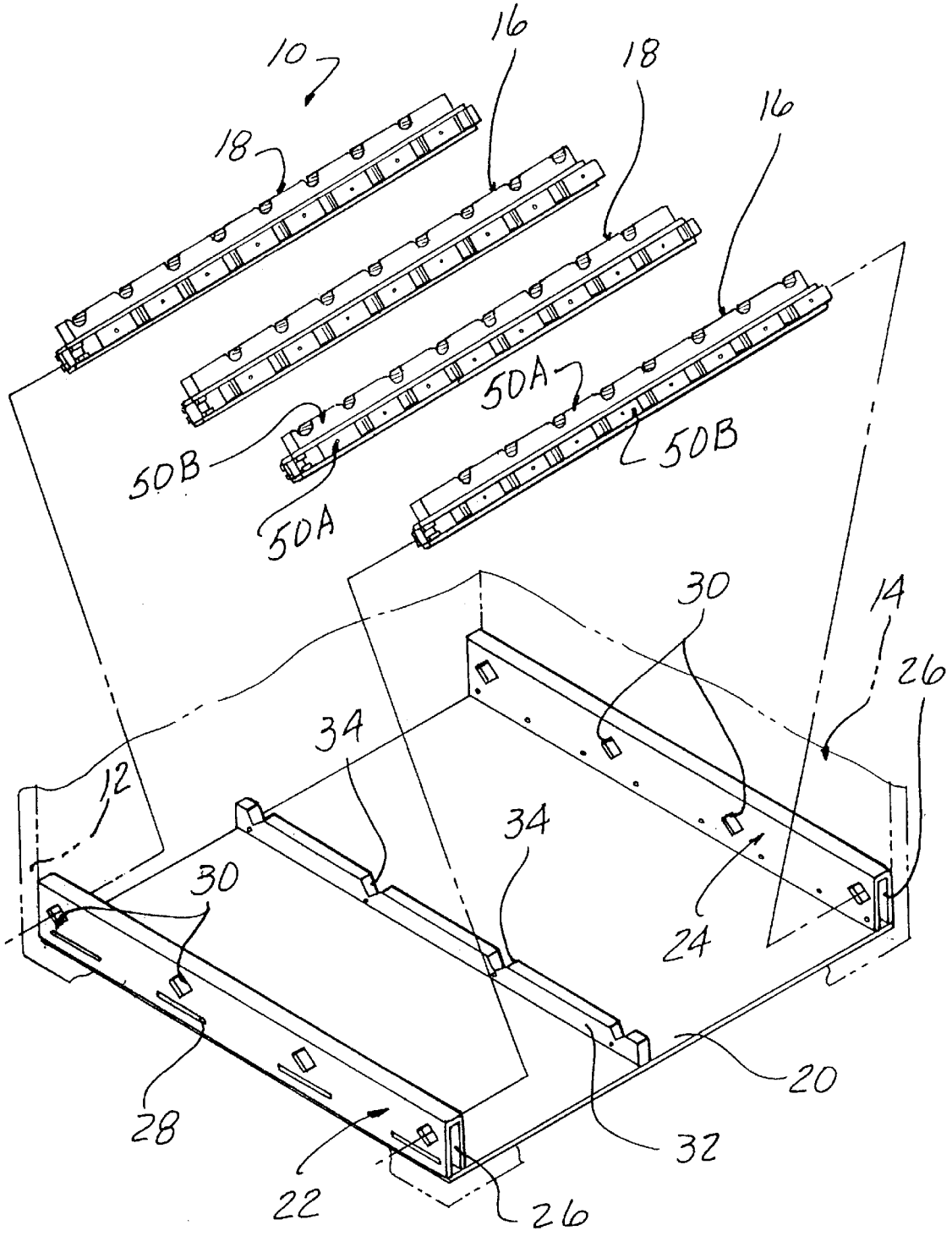
FIG. 1 is an exploded, perspective view of the base assembly of the article transport and storage apparatus of the present invention.

Referring now to the drawing, and to FIGS. 1–8 in particular, there is depicted one embodiment of an article transport and storage apparatus 10 which is devised for storing and transporting articles in a container 12.

It will be understood that the following description of the articles stored and transported by the apparatus 10 of the present invention as steering wheels will be understood to be by example only as the article transport and storage apparatus 10 of the present invention can also be utilized, without any or only minor modifications, to transport and store other articles, including both generally circular articles as well as articles having different exterior configurations and overall shapes.

As described in the following detailed description of the preferred embodiments and shown in the drawings, the article support apparatus 10 of the present invention is devised to be mounted in a container 12. Any container having any dimensions may be employed with the article transport apparatus 10 of the present invention. However, it is preferred that the container 12 be one having pivotal sides, such as a container sold under the trademark Ropak. As is known, such a container has pivotal sides which are hinged approximately ⅓ up from the bottom of the container. Latches are provided on the hinged portions of the side walls of the container to enable the side walls to be latched in a vertical use position forming a generally square or rectangular interior cavity within the container as well as enabling the hinged side wall portions to be dropped into a general horizontal, overlapped arrangement within the container for storage or transport back to the manufacturing facility wherein the overall height of the container is reduced to less than ½ of its article storage height.

Figures 2, 3:
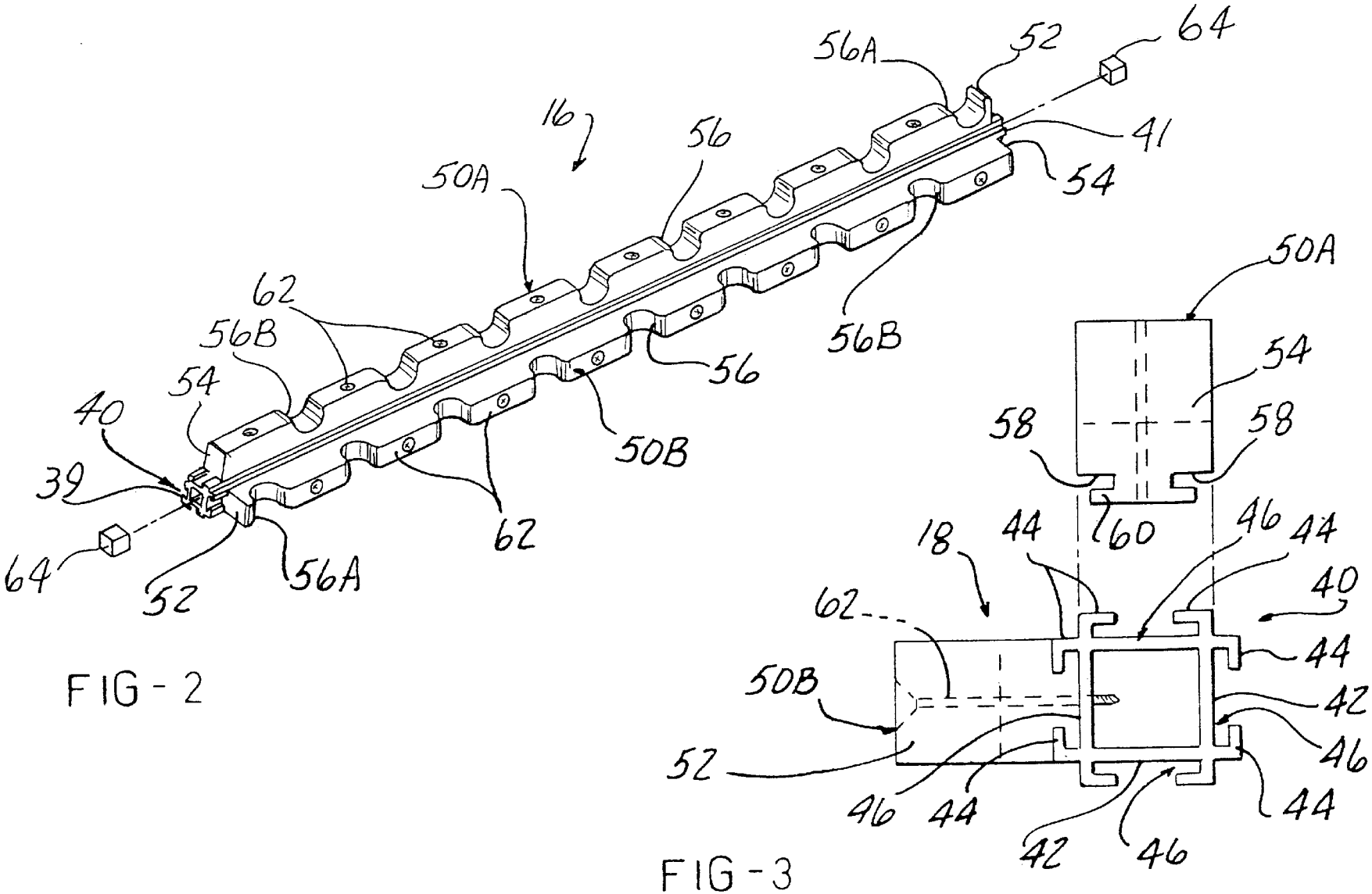
FIG. 2 is a perspective view of one of the base article support mans.
FIG. 3 is an end view of another base article support means.

As shown in FIGS. 1–3, the base assembly 14 has a planar bottom wall 20 and a pair of upstanding side walls 22 and 24. The side walls 22 and 24 are formed by folding over opposed end portions of the bottom wall 20 into two, spaced walls which are perpendicularly oriented with respect to the bottom wall 20. A substantially rigid nine pound density polyethylene foam strip 26 is mounted interiorly within each of the pair of spaced walls forming the side walls 22 and 24 for rigidity. Cable ties 28 extend through apertures in each side walls 22 and 24 and the foam strip 26 to secure each side wall 22 and 24 and the intervening foam strip 26 in the desired position with respect to the bottom wall 20.

A plurality of apertures 30 are formed at least partially and, preferably, completely through the wall portions of each side wall 22 and 24 as well as the intermediate foam strip 26. Although any shaped aperture 30 may be employed, in the preferred embodiment, each aperture 30 has a square cross-section disposed in the orientation shown in FIG. 1 for receiving the base article support means 16 and 18 therein, as described hereafter.

The base 14 is formed, by example only, of a plastic corrugated material, such as corrugated polyethylene or polypropylene. Other lightweight materials having the requisite strength may also be employed to form the base 14.

A center support 32 is fixedly mounted, such as by adhesive or screw fasteners, not shown, to the bottom wall 20 of the base 14 generally centrally between the opposed side walls 22 and 24. The central support 32 is preferably formed of a nine pound density polyethylene foam. A plurality of generally V-shaped notches 34 are formed along the length of the center support 32 and are aligned with the apertures 30 in the side walls 22 and 24 for supporting one of the base article support means 16 and 18 therein.

In the following description of the base article support means 16 and 18, it will be understood that the base article support means 16 and 18 are substantially identically constructed. The only difference between the base articles support means 16 and 18 is the orientation of the racks on the central tubular member.

As shown in detail in FIGS. 2 and 3, each base article support means 16 and 18 includes a centrally disposed tubular member 40. Preferably, the tubular member 40 is hollow and has a generally square cross-section formed of four joined side walls 42. A pair of inverted, upstanding, L-shaped flanges 44 project from the corners of the tubular member 40 and form open notches 46 adjacent each wall 42. Preferably, the tubular member 40 is formed as an extrusion of any suitable plastic, such as PVC, etc.

As shown in FIGS. 1 and 2, first and second ends 39 and 41 of each article support means 16 and 18 project outwardly from the adjacent ends 52 and 54 of the racks 50B and 50A, respectively. The first and second ends 39 and 41 of each tubular member 40 in each article support means 16 and 18 are inserted into the apertures 30 in the side walls 22 and 24 to enable the article support means 16 and 18 to be supported by the side walls 22 and 24 of the base 14.

In the base assembly 14, two of the notches 46 in the tubular member 40 receive a pair of individual racks 50A and 50B. The term "rack" as used herein, is defined as a slotted form or member and, more specifically, as an expanded thermoplastic, slotted foam member. Such racks are also referred to as dunnage. The "A" and "B" designation for the racks 50A and 50B are to identify the different orientations of the racks 50A and 50B on the tubular member 40. It will be understood that the racks 50A and 50B are identically constructed, with only their mounting orientation on the tubular member 40 differing as described hereafter.

As shown in FIG. 2, each of the racks 50A and 50B on the article support means 16 has a generally elongated shape between an opposed first end 52 and a second end 54.

A plurality of open ended notches denoted generally by reference number 56 are formed at equal spacings between the first and second ends 52 and 54 of each of the racks 50A and 50B. The notches 56, for the specific use in supporting steering wheels, have a generally circular cross-section. Obviously, other shapes for the notches 56 may be employed to support different shaped articles on the racks 50A and 50B.

For purposes of the following description, the endmost notch adjacent the first end 52 of each of the racks 50A and 50B will be denoted by reference number 56A. The first notch adjacent to the second end 54 of each of the racks 50A and 50B will be denoted by reference number 56B. As shown in FIG. 2, the notch 56A is spaced closer to the first end 52 of each rack 50A and 50B than the notch 56B is spaced from the second end 54 of each of the racks 50A and 50B. This provides nesting of the articles within the container 12 as described hereafter.

Preferably, each of the racks 50A and 50B are formed of a material which provides a non-scratch, non-marring surface for use with articles having a Class A exterior surface, such as steering wheels, etc. The racks 50A and 50B are also formed of a material which resists dirt and other debris so as to provide a durable, long term use life. By example only, each of the racks 50A and 50B is formed of a cross-linked polyethylene foam. This material is easily molded into the illustrated shape of each rack 50A and 50B. The notches 56 may also be machined into each rack 50 and 50B.

Other materials may also be employed to form each of the racks 50A and 50B, such as polyvinyl nitryl foam, polyvinylchloride foam, rubber foam, and ethyl vinyl actate (EVA) foam. As shown more clearly in FIG. 3, each rack 50A and 50B has a pair of slots 58 formed adjacent a bottom flange 60 which has a shorter overall width than the width of the main portion of the rack 50A or 50B. The bottom flange 60 is sized to fit within the notch 46 on any of the side walls 42 of the tubular member 40, with the slots 58 engaging the L-shaped flanges 44 on the tubular member 40 to securely mount each rack 50A and 50B on one of the walls 42 of the tubular member 40. Each rack 50A and 50B is slid into one notch 46, tubular member 40 in the desired orientation.

Fasteners 62, such as screws, may be provided through each enlarged portion of the racks 50A and 50B between adjacent notches 56 and into the wall 42 of the tubular member 40 to provide to prevent separation of the racks 50A and 50B from the tubular member 40. End plugs 64, shown in FIG. 2, are insertable into the opposed open ends of the tubular member 40 for closing the interior of the tubular member 40 and to prevent inadvertent contact with the inner ends of the fasteners or screws 62. The plugs 64 may be formed of the same cross-linked polyethylene material used to form the racks 50A and 50B.

As shown in FIGS. 1–3, the article support means 16 and 18 are provided in two pairs on the base 14. FIGS. 2 and 3 depict the different orientations or mounting positions of the racks 50A and 50B on the tubular members 40 which define the only difference between the article support means 16 and 18. As can be seen clearly in FIG. 2, the racks 50A and 50B are mounted on the tubular member 40 in 180° reversed manner. For the article support means 16, the first end 52 of the rack 50A is disposed adjacent to the second end 41 of the tubular member 40; while the first end 52 of the rack 50B is disposed adjacent to the first end 39 of the tubular member 40. The racks 50A and 50B are disposed on two immediately adjacent walls 42 of the tubular member 40.

In the opposed article support means 18 of each pair of article support means 16 and 18, the racks 50A and 50B are mounted on the tubular member 40 in the same orientation as shown in FIG. 2; but only on different walls 42. Specifically, the first end 52 of the rack 50B is disposed adjacent to the first end 39 of the tubular member 40; while the second end 54 of the rack 50A is disposed adjacent to the same first end 39 of the tubular member 40. This arrangement offsets all of the notches 56, including the notches 56A and 56B, in each of the racks 50A and 50B along the length of the racks 50A and 50B from the notches 56 in the adjacent rack 50B or 50A to provide nesting of the articles therein as described hereafter.

Figure 4:
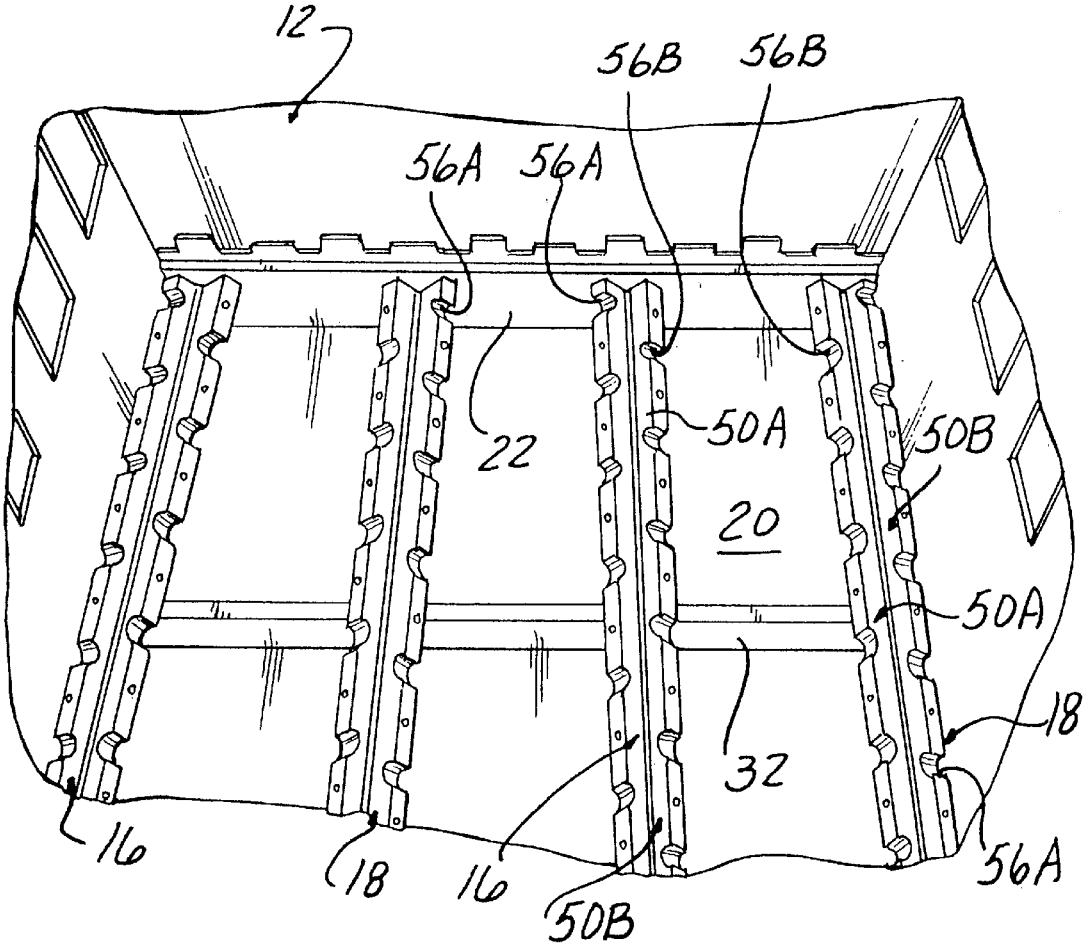
FIG. 4 is a perspective view showing the mounting of the base assembly in a container.

FIG. 4 depicts the mounting of the pairs of article support means 16 and 18 on the base 14 as well as the mounting of the base 14 in the bottom of the container 12. As shown in FIGS. 1 and 4, the side walls 22 and 24 of the base 14 are disposed adjacent the lower portions of two opposed side walls of the container 12, with the bottom wall 20 of the base 14 supported on the bottom wall of the container 12.

As shown in FIG. 4, the above described mounting arrangement of the two pair of article support means 16 and 18 forms three rows of opposed pairs of notches 56A and 56B. Due to the different mounting positions of the racks 50A and 50B on the article support means 16 and 18 and the alternating mounting of the article support means 16 and 18 across one dimension of the base 14, the notches 56A in each pair of article support means 16 and 18 as well as the notches 56B in opposed pairs of article support means 16 and 18 are laterally align with like notches 56A or 56B to receive one article, such as the peripheral rim or edge of a steering wheel, as described hereafter and shown in FIG. 5. Further, each pair of similar, opposed notches 56A and 56B are longitudinally offset along the other dimension of the base 14 to offset and nest two adjacent articles in two adjacent rows.

Figure 6:
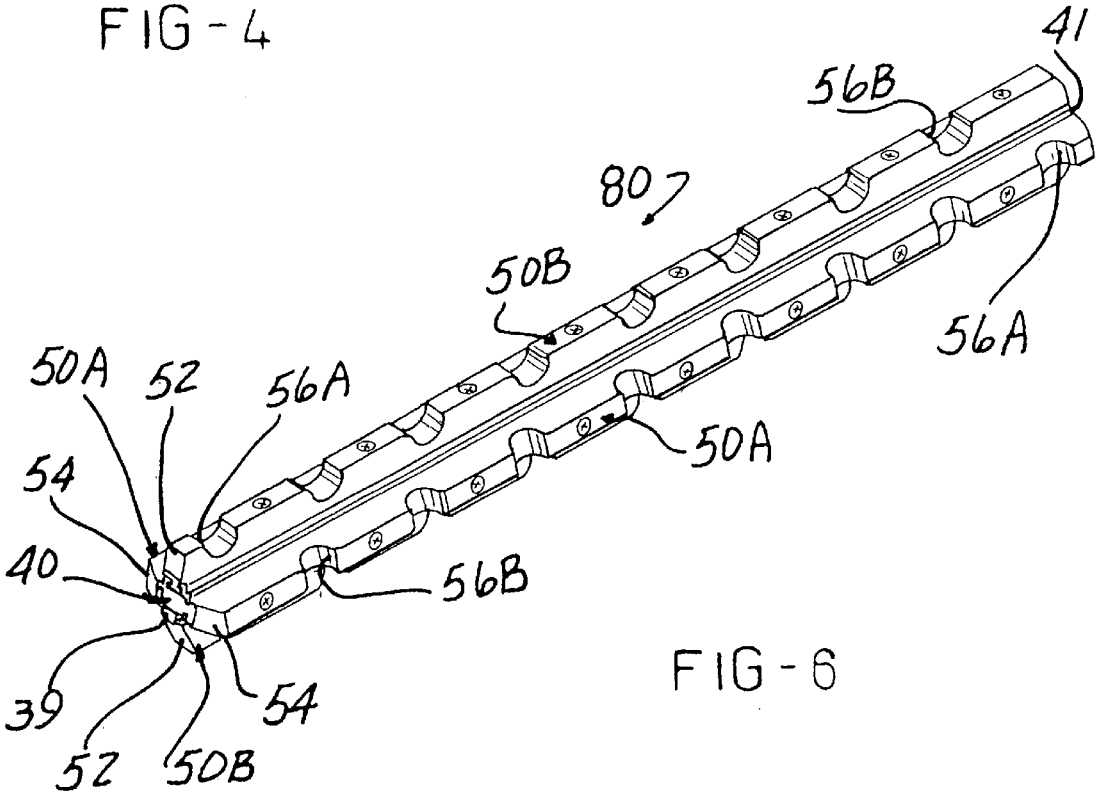
FIG. 6 is a perspective view of an article support means with four racks.
Figure 9:
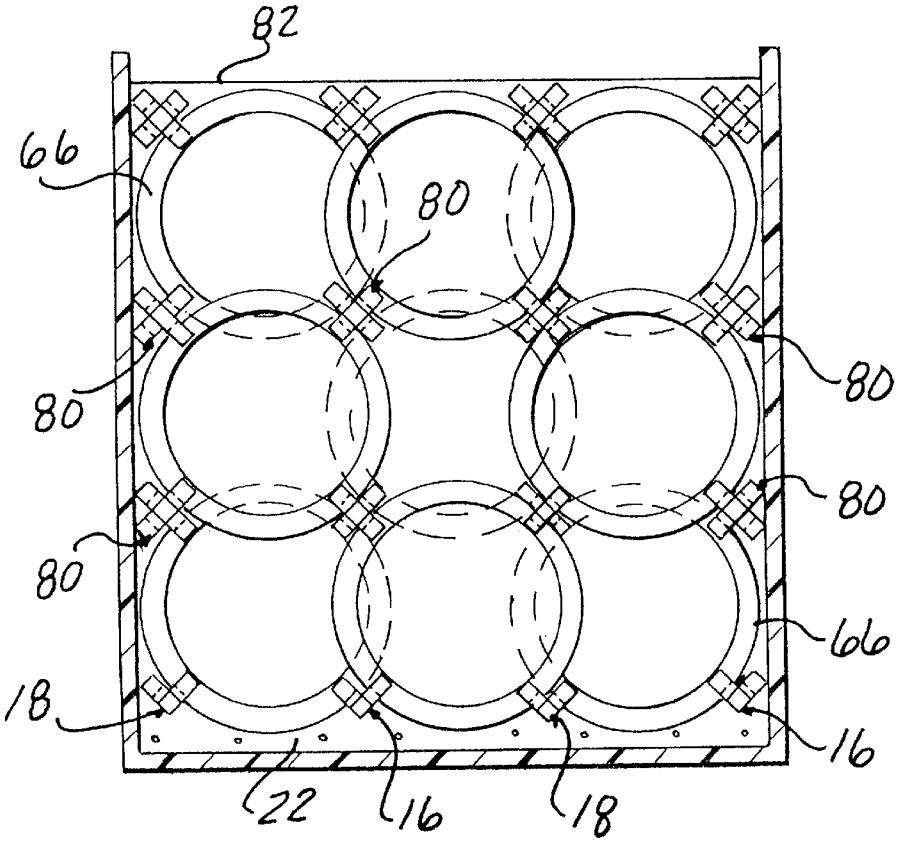
FIG. 9 is an end elevational view with one wall of the container broken away to show the nested mounting of a plurality of rows and tiers of steering wheels within the container.

This offset or staggered arrangement of the steering wheels 66 in the three rows formed by the two pair of article support means 16 and 18 on the base 14 is shown in FIGS. 6 and 9. Due to the closer spacing of the notches 56A in the center row to the side wall 22 than the adjacent pair of notches 56B in the two adjacent rows, steering wheel 66 when mounted in notches 56A in the center row on the base 14, will be disposed closer to the side wall 22 of the base 14 than the steering wheels 66 in the two adjacent rows. This nests the peripheral edge or rim 68 of the steering wheel 66 in the center row in a horizontal, overlapped or nested manner with the rims 68 of the laterally adjacent steering wheel 66 in the two outer rows.

Figure 5:
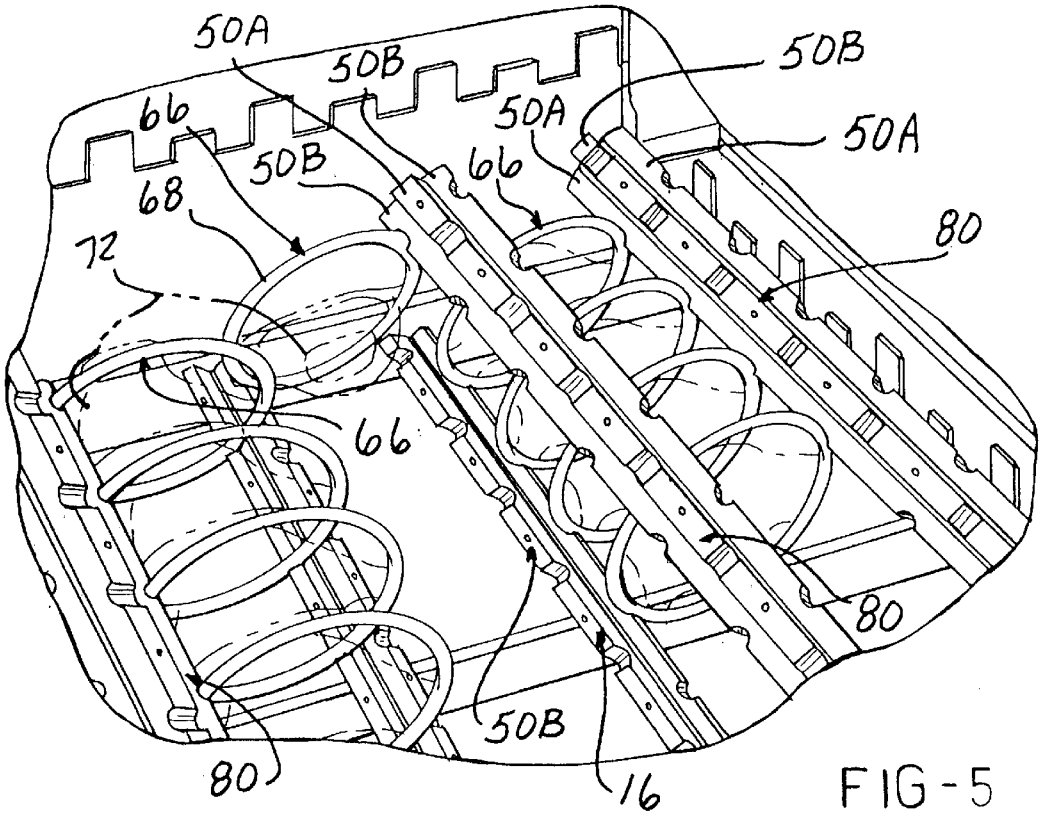
FIG. 5 is a perspective view of the base assembly with a partial complement of steering wheels mounted thereon.
Figure 7:
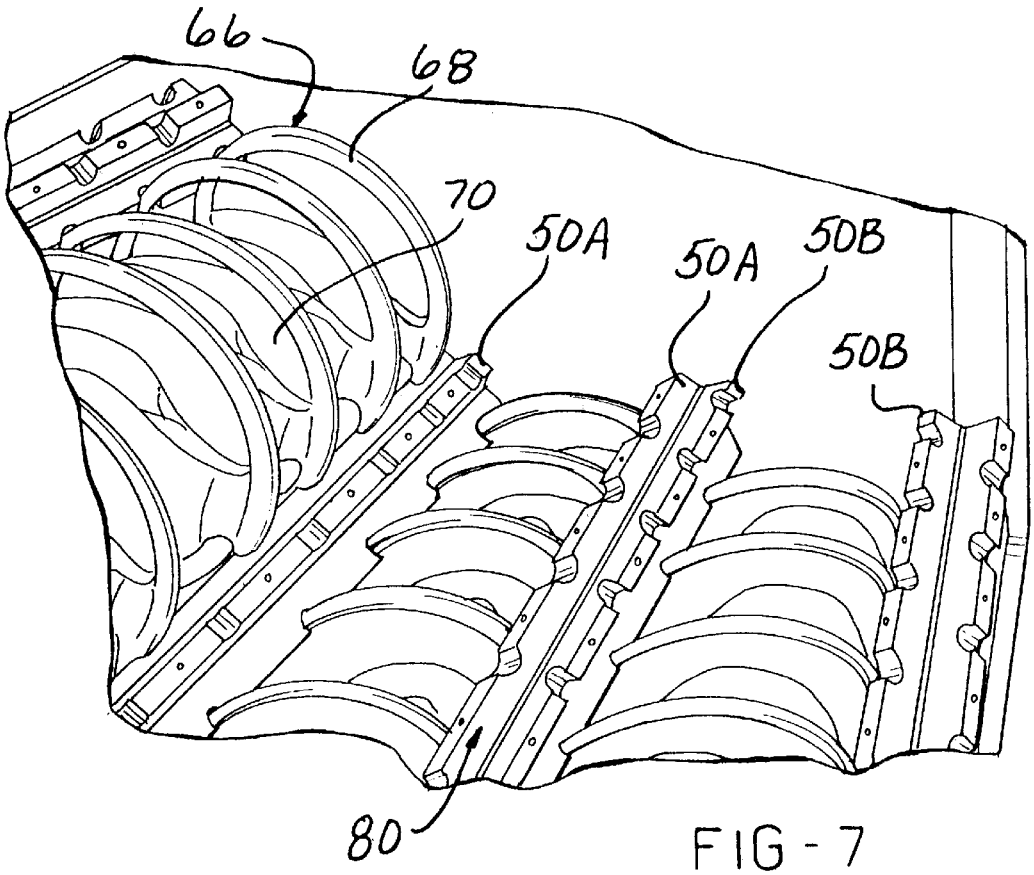
FIG. 7 is a perspective view showing mounting of the second tier of articles on the article support means of the base assembly.

By way of example only, the steering wheel 66, as is conventional, has a front surface 70 shown in FIG. 7 and a rear surface 72 shown in FIG. 5. The rear surface 72 projects away from the rim 68 a greater distance than the front surface 70 which is generally in line with the plane of the rim 68.

In the mounting position of the steering wheels 66 on the base 14, as shown in FIGS. 5 and 7, the steering wheel 66 in the center row is oriented on the base 14 with the front surface 70 facing or disposed immediately adjacent to the side wall 22 of the base 14. The rear surface 72 of each steering wheel 66 in the center row extends toward the opposite side wall 24, not shown in FIG. 5. Oppositely, the steering wheels 66 in the two outer rows are oriented with the rear surface 72 projecting toward the side wall 22. Since the rear surface 72 has a smaller diameter outer periphery than the rim 68, the rim 68 of the steering wheel 66 in the center row easily nests horizontally between the rims of two adjacent steering wheels 66 in each of the two outer rows of steering wheels 66.

Referring now to FIGS. 5–9, there is depicted an article support means 80 which is used to form upper rows of article support means above the rows of articles supported on the base 14 and described above. The article support means 80 is also devised to support the upper rows on the base rows of articles in a free standing manner without engagement or connection to the side walls of the container 12 in which the article support means 80 is disposed.

The article support means 80 is similar to the article support means 16 and 18 described above. Like elements in the article support means 16, 18 and 80 will be described and depicted by the same reference number. The article support means 80 includes a centrally disposed tubular member 40 having the outward opening notches 46 formed on all four walls 42, in the same manner as shown in FIG. 3. The article support means 80 includes two pairs of generally co-planar, aligned racks 50A and 50B.

Each identically oriented rack 50B is arranged in a common plane on oppositely disposed walls of the tubular member 40. The racks 50A project perpendicularly outward from opposite sides of the co-planar aligned racks 50B. Similarly, the pair of racks 50A are arranged co-planarily on opposed walls 42 of the tubular member 40, with the racks 50B projecting perpendicularly outward from opposite sides of the co-planarily arranged pair of racks 50A.

In this orientation, the notches 56 in each pair of racks 50B are aligned. Similarly, the notches 56 in the pair of racks 50A are aligned. However, the aligned pairs of notches 56 in the pair of racks 50A and 50B are longitudinally offset along the length of the tubular member 40 from the aligned notches 56 in the opposed pair of racks 50B or 50A. This enables a plurality of article support members 80 to be mounted on the rows of steering wheels 66 supported on the base 14, as shown in FIGS. 5, 7 and 9 with the notches 56 in the racks 50A and 50B of the article support means 80 positioned to engage alternating steering wheels 66 into two adjacent rows of steering wheels 66.

As shown in FIG. 5 and 9, the article support means 80 are arranged in two pairs with one article support means in each pair of article support means 80 being rotated 90° relative to the orientation of the other article support means in each pair.

As shown in FIG. 5, the pair of article support means 80 which are disposed 90° longitudinally with respect to each other are arranged relative to each other in two adjacent rows, including the center row and one outer row of steering wheel 66 mounted on the base 14, such that the notches in one rack 50A of the article support means 40 engage the steering wheel 66 in the center row: while the notches in the immediately adjacent rack 50B on the under side of the article support means 80 in the orientation shown in FIG. 5, engage the steering wheel 66 in the immediately adjacent outer row. Similarly, the outermost article support means 80 is oriented such that the notches in one rack 50B engage the steering wheel 66 in the outer row of steering wheels 66. The other pair of article support means are similarly arranged for engaging nested steering wheels 66 in the center row and the other outer row of steering wheel 66.

Figure 8:
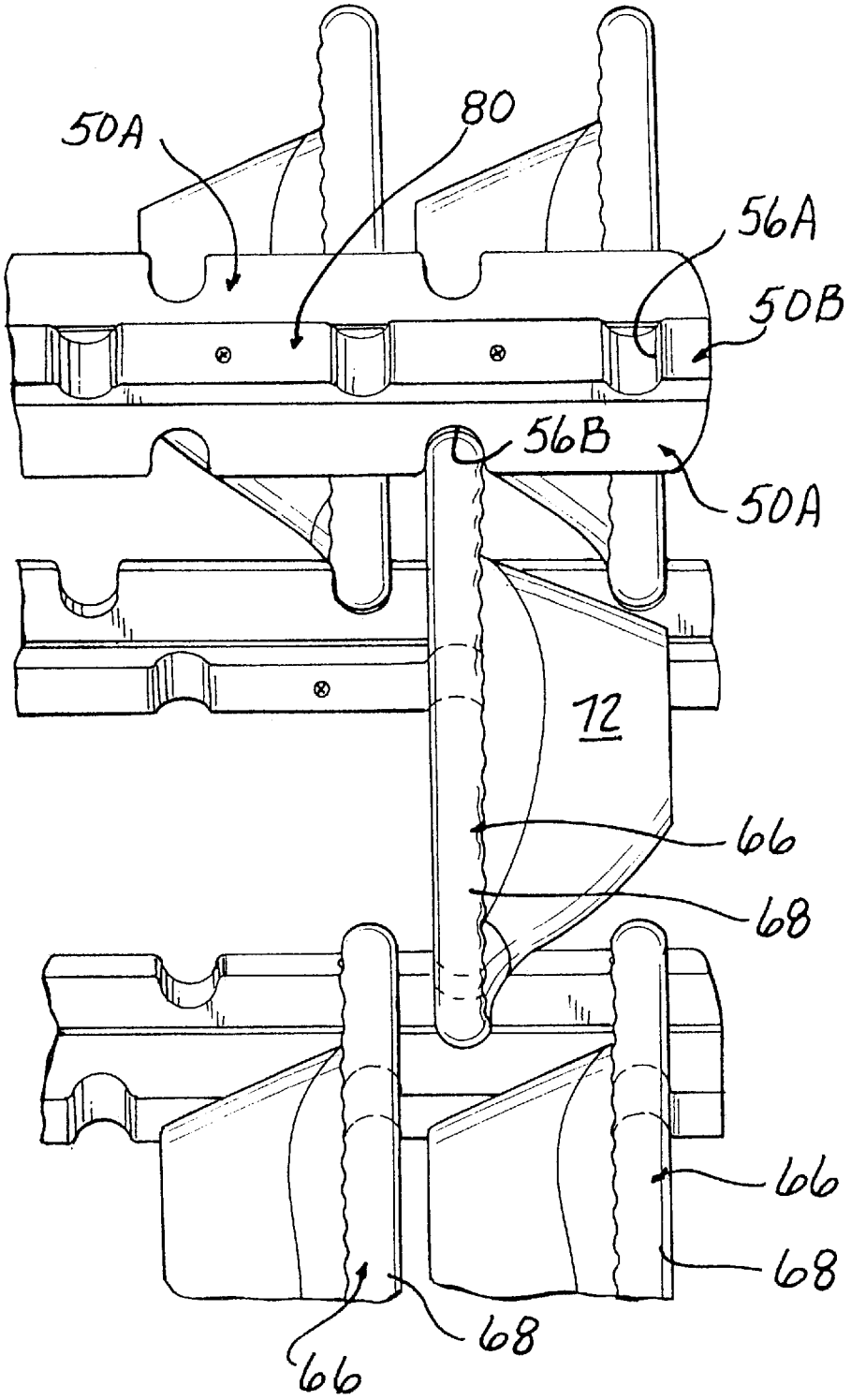
FIG. 8 is an enlarged, side elevational view showing the two dimensional vertical and horizontal nesting of the steering wheels in multiple rows and tiers in a container.

This arrangement places alternating racks 50A and 50B in an upward facing, generally angular position for mounting steering wheels 66 in a row above the steering wheels 66 mounted on the base 14. This mounting arrangement also provides for vertical nesting of steering wheels 66 between two vertically adjacent rows of steering wheel 66 as shown in FIGS. 7–9. Since like arranged racks 50A are disposed uppermost in the pair of article support members 80 shown in FIG. 5 above the steering wheels 66 mounted on the base 14, a steering wheel 66 may be mounted into the notches 56A at the first end 52 of the racks 50B. In this position, as similarly shown in FIG. 8 for a center row disposed steering wheel 66, the bottom portion of the rim 66 of the steering wheel mounted in the notches 56 in the racks 50B is nested between adjacent rims 68 of steering wheels 66 in the bottom row of steering wheels 66. This applies equally to all of the other steering wheels 66 mounted in the racks 50B on the outermost row of steering wheels 66.

At the same time, the orientation of the article support means 80 places the apertures 56B in the adjacent racks 50A farther away from the side wall of the container 12, as shown in FIGS. 5 and 7, so as to be able to receive the rim 68 of a steering wheel 66 in a position to enable the rim 68 to nest between two adjacent steering wheels 66 in the bottom center row of steering wheels 66. The arrangement of notches in the other outer row of steering wheels 66 above the outer base row of steering wheel 66 is the same as the opposed outer row described above.

This two way or two dimensional nesting of the steering wheels 66 includes both horizontal nesting between side-by-side disposed rows of steering wheels 66 and vertical nesting between two vertically disposed rows of steering wheels 66 as shown in FIGS. 8 and 9.

In use, the base 14 is mounted in the bottom of a container 12 with the side walls 22 and 24 projecting upwardly from the bottom wall 20. The pairs of article support means 16 and 18 are mounted in the apertures 30 in the side walls 22 and 24 and supported on the center support 32. A bottom tier formed of three rows of horizontally or side-by-side nested steering wheels 66 are mounted in the notches of the article support means 16 and 18 as shown in FIG. 5 until the entire lower tier of three rows of notches in the pairs of article support means 16 and 19 are filled with steering wheels. Two pairs of article support means 80 are then mounted on the outer edges of the steering wheels 66 in the outermost base rows of steering wheels 66 as shown in FIG. 5 as well as on nested portions of the rims 68 of the steering wheels 66 in the center base row of steering wheels 66. This enables a second tier, also formed of three rows of steering wheels 66, to be inserted in the article support means 80 as shown in FIGS. 7–9. It should be noted that each upper tier of rows of steering wheels 66 are fully supported on the adjacent lower row of steering wheels 66 without requiring any connection to or support on the side walls of the container 12.

As shown in FIGS. 8 and 9, a third or uppermost row of article support means 80 are then inserted over adjacent rims 68 to enable a third tier of three rows of steering wheels 66 to be inserted into the container 12.

When full, a dust cover 82 is placed over the top tier. The container 12 is now ready for shipping to the steering wheel installation plant. The container 12 may be placed immediately adjacent the production line at the location where the steering wheels are to be installed in vehicles thereby enabling the supply of steering wheels 66 to be readily accessible by an assembly line worker. One side of the container side walls can be pivoted downward allowing access to the steering wheels 66 within the interior of the container 12. In order to provide access to each tier of rows of steering wheels 66, the article support means 80 are removed from the container 12 one tier at a time. As each tier of rows of steering wheel 66 is removed from the container 12, the underlying article support means 80 are removed to allow access to the next lower tier of rows.

When the final steering wheel 66 has been removed from the base 14, all of the article container means 80 which have been previously removed from the container 12 may be placed back into the interior of the container 12. As described above, the side walls of the container 12 may be pivoted inward into an overlapping arrangement to reduce the height of the container 12 and simplify the return of the container 12 to the facility in which the steering wheels are manufactured.

Figure 10:
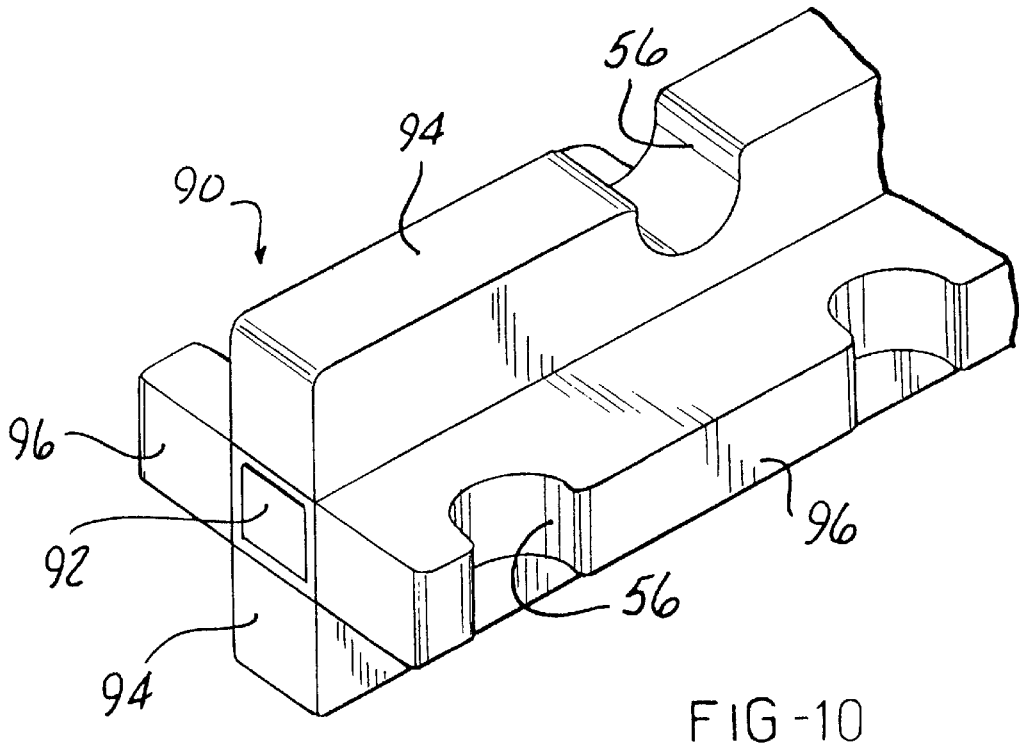
FIG. 10 is a perspective view of another embodiment of the article support of the present invention.

FIG. 10 depicts an alternate embodiment of an article support means 90 according to the present invention. In this embodiment, the central tubular member 92 is in the form of a hollow, tube formed of a suitable plastic, such as PVC, etc. A plurality of article support racks 94 and 96 are mounted on the flat exterior surfaces of the central tubular member 92 by means of a suitable adhesive. The racks 94 and 96 are similar to the racks 50A and 50B described above and are provided with notches 56 longitudinally offset in the same manner as also described above.

It is also possible to provide fasteners, not shown, through the enlarged portions of each of the racks 94 and 96 and into the central tubular member 94 for additional strength in retaining the racks 94 and 96 on the tubular member 92.

The article support means 90 shown in FIG. 10 is a direct replacement for the article support means 80 and, when provided with one two racks 94 and 96, may be employed as the base article support means 16 or 18.

In summary, there has been disclosed a unique article transport and storage apparatus which is ideally suited for storing and transporting a plurality of generally articles, such as vehicle steering wheels. The apparatus provides the unique feature of nesting the steering wheels both horizontally and vertically to maximize the number of steering wheels which can be stored within given sized container. Article support members are mounted between adjacent rows and between adjacent tiers of steering wheels in the container for supporting higher rows on lower rows without requiring any connection to the side walls of the container. The article support means includes notched racks which are formed of a durable, smooth surface material which is ideal for contacting an article having a Class A surface.

What is claimed is:

1. An apparatus for storing a plurality of articles having a peripheral surface in the container having side walls and a base, the apparatus comprising:

a plurality of individual article support means for supporting a plurality of articles in at least two longitudinally extending rows and in at least two vertical rows independent of the side walls of a container; and the article support means including a plurality of notches for receiving the peripheral surface of an article, the notches in the article support means being offset from the notches in two adjacent article support means to nest the articles in one article support means within the articles in two adjacent article support means.

2. The apparatus of claim 1 wherein:

the notches are offset between two adjacent horizontal rows and between two adjacent vertical rows of article support means to nest the articles in two dimensions in two adjacent horizontal and in two adjacent vertical rows.

3. The apparatus of claim 1 wherein the article support means comprises:

a tubular member having four side surfaces;

a rack having a plurality of notches spaced therealong; and means, cooperating between the rack and one side surface of the tubular member, for slidingly mounting each rack on the one side surface of the tubular member.

4. The apparatus of claim 3 wherein the tubular member comprises a hollow extrusion.

5. The apparatus of claim 3 wherein:

the tubular member includes inward facing flanges at each corner, the inward facing flanges forming a slot opening to one side wall of the tubular member for receiving one rack therein.

6. The apparatus of claim 5 wherein:

each rack has a pair of opposed slots mountingly engagable with the inward facing flanges on the tubular member.

7. The apparatus of claim 3 wherein:

the racks are arranged in two opposed co-planar pairs on the tubular member;

the notches on each rack being equally spaced from each other;

one endmost notch on one rack spaced closer to a first end of the rack than the opposite endmost notch is spaced from the second end of the rack;

notches in each co-planar pair of racks being aligned; and notches in opposed pairs of racks being offset.

8. The apparatus of claim 1 further comprising:

a pair of side walls for supporting the article support means.

9. The apparatus of claim 8 wherein the side walls further comprise:

apertures in each wall member; and means for interconnecting the article support means and the apertures.

10. The apparatus of claim 9 wherein the interconnecting means comprises:

opposed ends of the tubular member extending outward beyond the ends of the racks mounted thereon.

11. The apparatus of claim 8 further comprising:

two racks mounted on the support member.

12. The apparatus of claim 8 further comprising:

the pair of side walls interconnected by a base.

13. The apparatus of claim 12 wherein the base comprises a base wall and the side walls being a one piece integral member.

14. The apparatus of claim 12 further comprising:

a central rib mounted on the base wall between the side walls and supporting an intermediate portion of the article support members.

15. The apparatus of claim 11 wherein the racks are reversed 180° in orientation from each other on each tubular member.

16. The apparatus of claim 3 wherein each rack is formed of cross-linked polyethylene.

17. An apparatus for storing a plurality of articles having a peripheral surface in the container having side walls and a base, the apparatus comprises:

a plurality of individual article support means for supporting a plurality of articles in a plurality of longitudinally extending rows independent of the side walls of a container; and the article support means including a plurality of notches for receiving the peripheral surface of a plurality of articles, the notches in the article support means being offset between two adjacent article support means to nest the articles in one article support means within the articles in two adjacent articles support means.

* * * * *